United States Patent [19]

Digre

[11] 4,293,741

[45] Oct. 6, 1981

[54] MAGNET ASSEMBLY

[76] Inventor: Clifford B. Digre, 4745 Vincent Ave. South, Minneapolis, Minn. 55410

[21] Appl. No.: 50,873

[22] Filed: Jun. 21, 1979

[51] Int. Cl.[3] ..... H04R 9/02

[52] U.S. Cl. ..... 179/115.5 PC; 179/119 R; 335/231

[58] Field of Search ..... 179/115.5 PC, 115.5 R, 179/117, 119 R, 120; 181/161, 165, 171, 172, 157; 235/231, 306

[56] References Cited

U.S. PATENT DOCUMENTS

| | | | |
|---|---|---|---|
| 2,950,359 | 8/1960 | Perry | 179/115.5 PC |
| 2,974,204 | 3/1961 | Supitilov | 179/115.5 PC |
| 3,079,472 | 2/1963 | Sariti | 335/231 |
| 3,176,086 | 3/1965 | Coen | 179/119 R |
| 3,310,639 | 4/1967 | Collins | 179/120 |
| 3,413,579 | 11/1968 | Sloan | 335/231 |
| 3,453,400 | 7/1969 | Coen | 179/119 R |
| 3,593,239 | 7/1971 | Hofman | 335/231 |
| 3,898,393 | 8/1975 | Digre | 179/115.5 PC |
| 4,158,756 | 6/1979 | Keezer | 179/119 R |

*Primary Examiner*—Gerald L. Brigance
*Attorney, Agent, or Firm*—Merchant, Gould, Smith, Edell, Welter & Schmidt

[57] ABSTRACT

A loudspeaker design for use in transmitting and receiving sound waves is disclosed. The loudspeaker consists of a basket (12) and magnet assembly (14). The magnet assembly consists of a sandwich of front (16) and back (20) plates on either side of a ring-shaped ceramic magnet (18). The back plate (20) has a pole piece (22) projecting outward therefrom. The ceramic magnet (18) has a center aperture. The magnet (18) is affixed to back plate (20) concentrically around the projecting pole (22). The front plate (16) is circular in shape and also has a center aperture (31). A centering device and shield (24) is placed concentrically around the projecting pole (22) and is adjacent to the inside surface of the back plate (20), the inner surface of the aperture (30) within the ceramic magnet (18), and the inner surface of front plate (16) when it is affixed to the ceramic magnet, thereby creating the above-mentioned sandwich. The front plate (16) has a lip (34) on its outer surface and a recess (42) in its inner surface. Lip (34) has an outer diameter (38) slightly less than that of the center hole in the speaker basket (12). The speaker basket is attached to the magnet assembly by placing lip (34) within the hole in the speaker basket and staking the two together. The inner recess (42) of the front plate (16) is designed to accept the vertical wall of the magnet centering device and shield (24) so as to prevent the entry of particles of magnet and other foreign materials into the air gap (46) in which the speaker voice coil must move.

16 Claims, 4 Drawing Figures

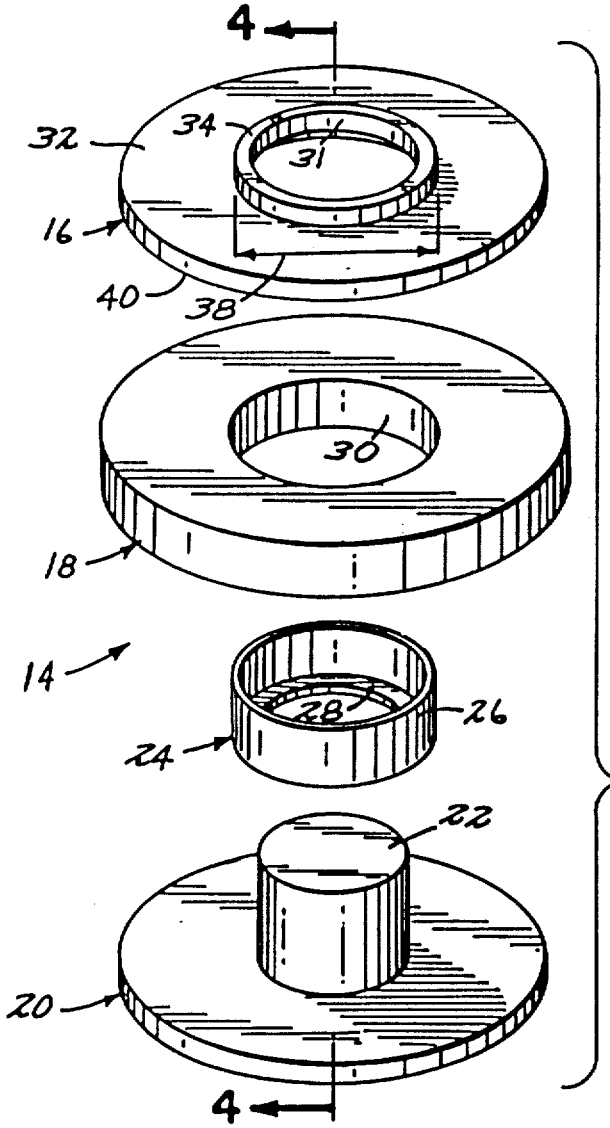
FIG. 2
FIG. 1
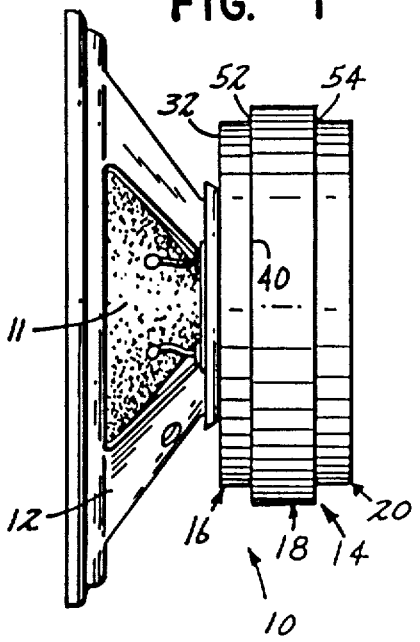
FIG. 3
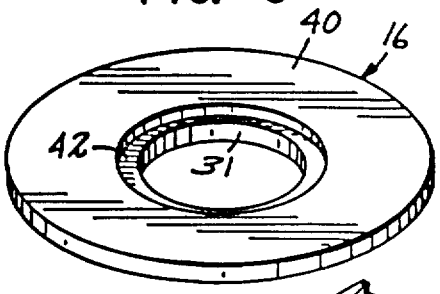
FIG. 4
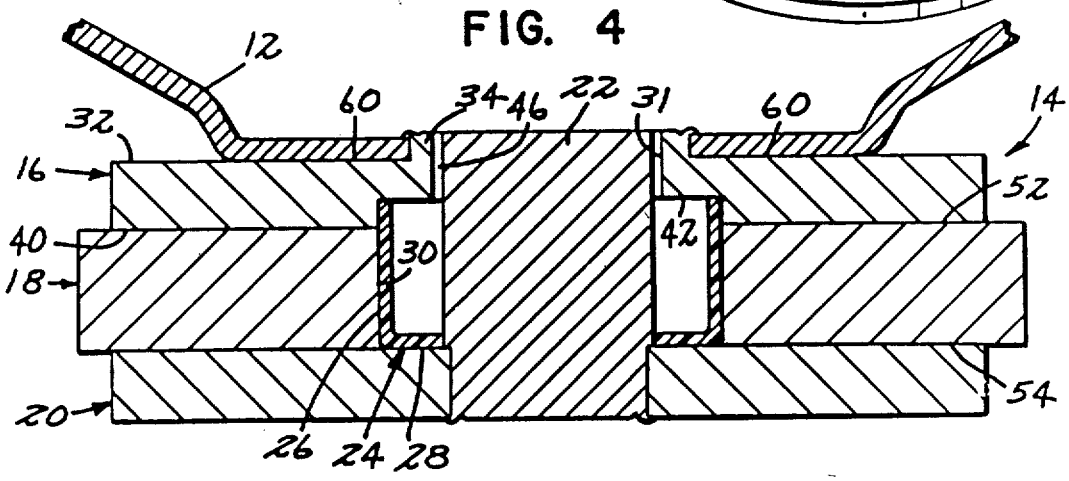

MAGNET ASSEMBLY

TECHNICAL FIELD

The present invention relates to sound transducer assemblies, more particularly the attachment of a ceramic magnet assembly to a loudspeaker basket.

BACKGROUND OF THE PRIOR ART

As is well known, a loudspeaker comprises a frame or "basket" which supports the rim of a speaker cone of light, fairly rigid material such as stiff paper, the cone terminating near its apex by a cylindrical "voice coil", through which the audio frequency energization to the speaker passes. The basket also supports a magnet assembly to create a fixed radial magnetic field in which the voice coil can move axially because of the resilience of the speaker cone. Magnet assemblies typically employ ceramic magnets although some use alnico magnets. Many magnet assemblies employ a flat front plate which forms part of the assembly and serves as the surface to which the basket is attached, as well as completing the magnetic path outside the voice coil, which it is apertured to pass. In the prior art, numerous methods were employed to secure the front plate to the basket, including welding or bolting the two parts together or forming staking studs in the front plate and piercing the basket with corresponding holes for accepting the studs, and then staking the studs thereby, bonding the two parts to each other.

All of these prior methods had significant drawbacks which resulted in increased cost of production. Bolting, for example, requires expensive drilling and tapping of the front plate. Stud staking requires specially designed front plates and the extra step of staking. In the welding process, alignment of the basket and front plate is difficult and quality control is a problem. These methods have also proved unsatisfactory for use in attaching a large magnet assembly to a small basket due to the lack of available surface area on the basket necessary to weld, bolt or stud stake.

SUMMARY OF THE INVENTION

The present invention comprises an improved loudspeaker structure which facilitates the connection of a magnet assembly to a basket without introducing the problems encountered in known methods. To accomplish this, the front plate of the magnet assembly is provided with a raised lip around its voice coil aperture, and the basket has a central aperture into which the lip fits. By staking the lip into the rim of the basket aperture at sites therearound, the front plate and basket are securely connected together without any space between them.

In a preferred form of the invention, a magnet centering device and shield is located between the front and back plates of the magnet assembly, in peripheral contact with the inner surface of the annular magnet, and this device extends axially beyond the front surface of the magnet into an annular recess formed in the back surface of the front plate. The annular recess may be dispensed with the axial extent of the centering device and shield being the same as that of the magnet, so that the shield preferably contacts the side of the front plate which faces the magnet.

Various advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there are illustrated and described preferred embodiments of the invention.

BRIEF DESCRIPTION OF THE DRAWINGS

Referring to the drawings, wherein like numerals indicate like elements:

FIG. 1 is a side view of a loudspeaker having my improved structure;

FIG. 2 is an exploded perspective view of a magnetic assembly portion of the speaker of FIG. 1 showing the front face of a front plate used therein;

FIG. 3 is a perspective view of the back face of the front plate of the speaker magnet assembly; and FIG. 4 is an axial section taken on the line 4—4 of FIG. 2 showing the parts thereof in assembled relationship.

DETAILED DESCRIPTION OF THE INVENTION

Referring to the drawings in detail, there is shown in FIG. 1 a loudspeaker assembly generally designated by the numeral 10 having a speaker cone 11, a basket 12, and a magnet assembly 14 including a front plate 16, a ring-shaped ceramic magnet 18 and a back plate 20. It should be noted that although magnet assembly 14 is shown as circular in shape, it is not limited to that form and may be square, etc.

An exploded view of magnet assembly 14 is shown in FIG. 2 of the drawings. Attached to the back plate 20 is a projecting pole piece 22. Both plate 20 and pole 22 are made of steel. Placed concentrically around the pole piece 22 is a magnet centering device and shield 24. A ceramic magnet 18 has flat pole faces and a circular aperture having an inner periphery 30 which is larger than the diameter of the pole 22 to define an annular space therearound. The front plate 16 has a central aperture 31 larger than pole piece 22, a front face 32, and a lip 34 having generally vertical walls projecting substantially perpendicularly from the front face and surrounding aperture 31. The lip 34 also has an outer diameter 38. The back face 40 of front plate 16 is shown in FIG. 3 of the drawings. Back face 40 contains an annular recess 42 of a radius larger than aperture 31 and extending thereto.

The centering device and shield 24 is made of a nonmagnetic material and has a cylindrical wall 26 and a bottom wall 28 which has an aperture therein. The centering device and shield is more completely described in my U.S. Pat. No. 3,898,393.

An axial section of the magnet assembly 14 is shown in FIG. 4 of the drawings. In this drawing, the cylindrical wall 26 of the centering device and shield 24 can be seen to have snug axial engagement with the recess 42 in the front plate 16. This is the preferred construction although manufacturing tolerance may produce some small space therebetween. It is, of course, also possible to use a centering device and shield with a wall of a height less than would be necessary to engage recess 42. Additionally, cylindrical wall 26 is preferably intimately disposed against the inner periphery 30.

The magnet assembly is typically held together as shown in FIG. 4 in a sandwich-like fashion where the ceramic magnet 18 is adhesively held to the front plate 16 and back plate 20 to define a voice coil air gap 46. A speaker basket 12 having a center hole is now placed over the lip 34 and then the lip may be staked to the basket to mount the speaker basket securely to the front plate and thus to the entire magnet assembly. This method of manufacture is completely sufficient in itself to hold the magnet assembly to the speaker basket. However, if desired, it is possible to weld, bolt or stud stake the basket to the front plate in addition to staking lip 34 for added rigidity if required. My staking method has numerous advantages over prior methods of mounting as discussed above. With a completely round and airtight seal between the speaker basket and front plate there is virtually no possibility of foreign particles entering the air gap 46 through the basket to front plate interface 60. A gasket (not shown) can be placed between the front plate and the speaker basket before staking in order to reduce resonance of the two parts should it be desired.

Foreign particles, including chips of ceramic magnet, are prevented from entering the air gap 46 from the interface 60 between the basket and front plate, or along the interfaces 52 and 54 between the magnet and front and back plates, by the magnet centering device and shield 24 and its cooperation with recess 42 in front plate 16. Ceramic chips from magnet 18 are completely blocked from entering gap 46 by the snug or close fit of shield 24 in the recess 42 and also against the plate 20. In the prior art, the back side of the plate 16 lacked recess 42 and thus it was possible even with shield 24, for particles to find their way past shield 24 to the air gap 46.

Preliminary investigation has indicated that the use of this front plate with the lip 34 and recess 42 may improve the linearity and efficiency of the magnetic field in the air gap 46. Linearity is a significant advantage in loudspeakers as non-linearity in the field causes a non-linear movment of the voice coil and in turn the speaker cone, creating a distorted audio response. Increased efficiency is a significant advantage in loudspeaker magnet circuits since increase in magnetic energy can result in increased sound pressure level and/or increased power handling ability. Comparisons were made of the total energy of the magnetic circuits by measuring the air flux (in maxwells) using a search coil and electronic integrator. It may be possible to further modify the magnetic field distribution in the air gap by altering the shape of recess 42 from the configuration shown to a non-flat configuration.

It is understood that although the invention is described in detail with respect to a ceramic magnet speaker assembly, the improved front plate as disclosed is equally applicable to other magnet assemblies having a flat front plate.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent extended by the broad general meaning of the terms in which the appended claims are expressed.

What is claimed is:

1. Sound transducing equipment comprising:

(a) a magnet assembly including (1) a back plate having a solid cylindrical pole piece projecting from a face thereof, (2) a magnet having an axis, first and second axially opposite polar faces, and an axial bore therethrough, (3) means affixing said first face of said magnet to said face of said back plate with said projecting pole disposed centrally within said axial bore, and (4) a front plate having first and second oppositely disposed faces, and having a circular aperture, said first face of said front plate being affixed against said magnet with said projecting pole disposed centrally within said aperture, said front plate further having a lip projecting outwardly from said second face whereby a concentric ring is formed around said projecting pole;

(b) a speaker basket having a center hole therein of a dimension no smaller than the diameter of said annular lip, said basket being positioned around said lip, the thickness of said speaker basket in the region proximate said center hole being less than the height said lip projects from said second face; and (c) means including outward deformation of said lip for holding said speaker basket in intimate engagement with said second face of said front plate.

2. Equipment in accordance with claim 1 wherein said first face of said front plate includes an annular recess concentric around said circular aperture in said front plate; and wherein said equipment includes a magnet centering device and shield having a cylindrical wall with top and bottom ends, and a bottom wall affixed to said bottom end of said cylindrical wall with an axial opening in said bottom wall, said bottom wall disposed adjacent to said projecting pole, said cylindrical wall disposed adjacent to said face of said back plate, said top end of said cylindrical wall disposed adjacent to said first face of said front plate.

3. Equipment in accordance with claim 2 wherein said annular recess is positioned so as to accept said top end of said cylindrical wall of said shield.

4. Equipment in accordance with claim 2 wherein said annular recess has a minimum radius no smaller than the radius of said bore in said magnet, said recess extending to said aperture.

5. Equipment in accordance with claim 3 wherein said recess has a flat surface.

6. Sound transducing equipment comprising:

(a) a magnet assembly including (1) a back plate having a face and a solid cylindrical pole projecting outwardly therefrom, (2) a magnet having first and second oppositely disposed faces and an axial bore therethrough, (3) means affixing said first face of said magnet to said face of said back plate with said projecting pole disposed centrally within said axial bore, and (4) a front plate having first and second oppositely disposed faces, and having a circular aperture, said first face of said front plate being affixed against said magnet with said projecting pole disposed centrally within said aperture, said front plate further having an annular lip projecting outwardly from said second face whereby a concentric ring is formed around said projecting pole; said plate having an annular recess around said circular aperture in said front plate, said recess having a flat bottom surface;

(b) a speaker basket of predetermined thickness having a hole therein of a diameter no smaller than the outer diameter of said annular lip, said basket being disposed over said lip, said lip extending beyond the thickness of said basket;

(c) securing means including deformations in said lip for securing said speaker basket to said second face of said front plate.

7. A magnetic assembly for attachment to a loudspeaker basket of predetermined thickness comprising:

(a) a back plate having a solid cylindrical pole projecting from one face thereof;

(b) an annular magnet having a face and an axial bore therethrough, said projecting pole being disposed centrally within said axial bore;

(c) means affixing said face of said magnet to said face of said back plate; and (d) a front plate having a face disposed against said magnet, said front plate having a circular aperture of a diameter less than said axial bore in said magnet but greater than the diameter of said projecting pole, said second plate further having a lip having generally vertical walls projecting outwardly and substantially perpendicularly from the other face of said front plate whereby a concentric ring is formed around said projecting pole to be received within said basket opening and wherein said lip extends outwardly beyond said basket.

8. A device in accordance with claim 7 wherein said one face of said front plate includes an annular recess extending into said one face having a minimum radius no smaller than the radius of said bore in said magnet, said recess extending to said annular aperture.

9. Sound transmitting or receiving equipment comprising:

(a) a speaker basket;

(b) a front plate having first and second oppositely disposed faces and a circular aperture, said first face of said front plate having an annular recess extending into said first face concentric with said circular aperture in said front plate;

(c) means affixing said basket to said second face of said front plate;

(d) a back plate having a cylindrical pole projecting from a face thereof;

(e) a magnet having first and second oppositely disposed faces and an axial bore therethrough, said projecting pole being disposed centrally within said axial bore;

(f) means affixing said first face of said magnet to said face of said back plate;

(g) means affixing said second face of said magnet to said first face of said front plate; and (h) a centering device and shield having a cylindrical top wall extending into said recess of a diameter less than said axial bore in said magnet, said shield further having top and bottom ends, and a bottom wall having an axial opening therein for engagement with such projecting pole.

10. Equipment in accordance with claim 9 wherein said annular recess is positioned so as to accept said top end of said cylindrical wall of said shield.

11. Equipment in accordance with claim 8 wherein said annular recess has a minimum dimension no smaller than the dimension of said bore in said magnet, said recess extending to said aperture.

12. Equipment in accordance with claim 11 wherein said recess has a flat bottom surface.

13. A front plate for securing a magnet assembly, including an annular magnet having a cylindrical shield, to a basket of known thickness having a mounting aperture, said plate comprising, in combination:

a flat inner surface for securement to said magnet coaxially with said shield;

a generally flat outer surface;

and an annular lip extending from said outer surface and sized to be received in said aperture without extending significantly beyond the thickness of said basket, whereby said plate may be secured in said basket by radially outward deformations of said lip.

14. A plate according to claim 13 in which said inner surface of said front plate includes a recess.

15. In a sound transducer, in combination:

a basket of predetermined thickness having an aperture:

a front plate, for a magnet assembly, including a generally flat outer surface and an annular lip extending from said surface and sized to be received in said aperture, said lip being of sufficient height to extend beyond the thickness of said basket when placed thereover;

and means, including radially outward deformations in said lip, for securing said plate in said aperture.

16. In a sound transducer, in combination:

a plate including a generally flat outer surface and an annular lip extending from said surface and sized to be received in an aperture of a speaker basket, said lip extending beyond the thickness of said basket;

and means, including radially outward deformations in said lip for securing said plate in said aperture.

* * * * *